United States Patent [19]

Kaymen

[11] Patent Number: 4,530,500

[45] Date of Patent: Jul. 23, 1985

[54] GOLF BALL POSITION MARKER AND STORAGE DEVICE

[76] Inventor: Joseph Kaymen, 938 Hemlock St., Deerfield, Ill. 60015

[21] Appl. No.: 622,959

[22] Filed: Jun. 28, 1984

[51] Int. Cl.[3] ..... A63B 57/00

[52] U.S. Cl. ..... 273/32 A; 224/269

[58] Field of Search ..... 273/32 A; 224/269

[56] References Cited

U.S. PATENT DOCUMENTS

| | | | |
|---|---|---|---|
| 2,978,335 | 4/1961 | Kidger | 426/568 |
| 3,139,690 | 7/1964 | Hait | 273/32 A |
| 3,208,123 | 9/1965 | Koos | 273/32 A X |
| 3,233,802 | 2/1966 | Ludwick | 273/32 A X |
| 3,620,426 | 11/1971 | Hatch | 273/32 A X |
| 3,918,718 | 11/1975 | Billow | 273/32 A X |
| 4,129,237 | 12/1978 | Grinder | 273/32 A X |
| 4,475,676 | 10/1984 | Smith | 273/32 A X |

*Primary Examiner*—William H. Grieb

[57] ABSTRACT

A combination of a storage device and a marker to mark the position of a golf ball resting on a putting green that can be worn on the waistband of slacks or skirt. Magnetism and a knob and hole mating arrangement reduce the chance of accidental dislodgment to acceptable levels yet allow for fast and easy removal and replacement of the marker.

1 Claim, 2 Drawing Figures

GOLF BALL POSITION MARKER AND STORAGE DEVICE

HISTORY AND BACKGROUND OF THE INVENTION

Ever since the rules of golf permitted the lifting, cleaning and replacing of a golf ball resting on a putting green golfers have used plastic discs, powder and dye dispensers, detachable buttons from golf gloves, markers which fit into the grip ends of putters and innumerable other means of marking the position of a golf ball on a green. Coins are the most popular. PGA and LPGA tour golfers use coins with a few exceptions. A few of the tour golfers wear slacks that have small pockets sewn into them for this purpose.

But ordinary slacks or skirts that golfers wear today are form fitting and as a result pockets are not easily entered in the search for a suitable coin. This tends to slow down play, a problem that plagues overcrowded courses.

Obviously a device for the safe storage, fast removal and replacement of a properly sized marker that could be worn on the exterior of golf clothing would help to speed play in addition to eliminating the soiling and wear and tear on clothing.

Pruitt No. 2978335 discloses a putter with an open recess at the top of the grip. A magnet holds a magnetizable marker within the recess. The marker is tilted for removal.

There are a number of reasons why this prior art proved to be unsuccessful. Golfers don't buy putters because of marker storage capability. They buy putters to fit their putting style.

It is expensive to modify a putter grip to hold a magnet and marker. Furthermore, the marker is too small.

A golf ball marker should be very close to one inch in diameter or the size of a quarter. This size is ideal because it is easily handled even in bad weather and can be seen in nearly all cases by all the golfers on the green. Its position in relation to the cup should be noted with care because to step on or walk across the line of any putt to the hole is a serious breech of golf etiquette. However, it is permissible to straddle a putting line when a short tap in will eliminate an additional lifting and marking of a ball position.

Grinders U.S. Pat. No. 4,129,237 shows a combination clip, snap button marker, tee holder and green repair tool. There are two objections to the marker. First, it is too small for reasons stated above. Second, the marker has a projecting knob that must be pressed into the soil to anchor it. Otherwise it can swivel by action of the wind. One of the basic rules in golf is not to disturb any part of a green except to repair the scar caused by a falling golf ball. A snap button when pressed into the soil violates this rule.

Up to this time violation of this rule has been ignored. It is only a matter of time until the rule will be clarified and enforced thus making snap buttons obsolete.

My invention bypasses all of the inconveniences inherent with pocket stored marking devices and coins. It also overcomes the objections in Pruitt's U.S. Pat. No. 2,978,335 and Grinder's U.S. Pat. No. 4,129,237. Moreover, it would be very inexpensive to produce. It is expected that the advertisement on the marker will offset the cost of production so that the device will be used as a free premium by golf equipment firms to golfers who buy their products.

Anybody moderately handy with simple tools can construct a working model of my invention with locally obtainable materials.

OBJECT OF THE INVENTION

The main purpose of my invention is to provide the user an ideal-sized golf ball position marker and a safe storage device for the marker that can be worn on the waistband or belt of slacks or skirt or any other suitable resting place where it will be out of the way of the arm movements of the golf swing.

A further purpose is to provide a method to remove the marker from safe storage quickly and easily and also to replace the marker just as quickly and easily by feel rather than visual guidance.

A still further purpose is to attain the foregoing objectives by a device which is simple and inexpensive to manufacture.

A final purpose is to have the two faces of the marker suitably prepared to accept printing for advertising or marking pen for the purpose of identification.

DRAWINGS

FIG. 1 shows a perspective view of the device from a small distance below eye level and slightly from the right of center. The drawing is approximately two times actual size in order to show details clearly.

FIG. 2. In the same scale as FIG. 1. This drawing shows a vertical cross section view exactly through the center of the device.

Figure 1:
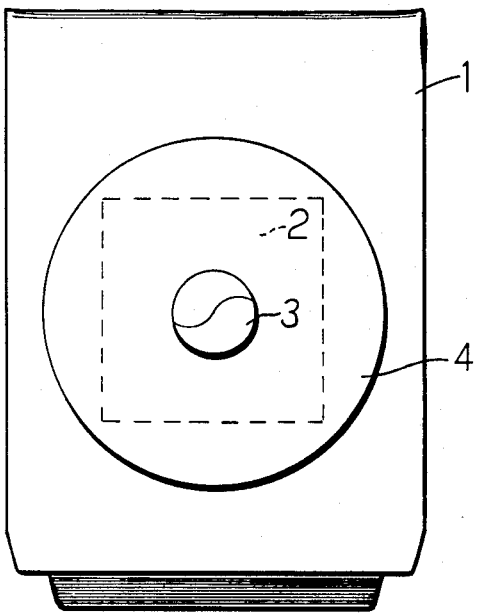
Referring to FIGS. 1 and 2 of the drawing the device consists of four parts. They are: Clip 1, Magnet 2: Knob 3; Marker 4. These descriptive names will be used throughout to identify these four parts.
Figure 2:
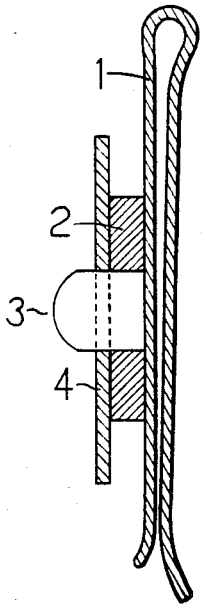

The clip 1 is formed from plastic or metal to have a springlike quality to hold it in place over the waistband or belt of slacks or skirt, out of the way of the arm movements of the golf swing. Tension and friction hold it in place.

The magnet 2 is shown as square for economy reasons (but can be any suitable shape) and is affixed to the front of the clip 1. Its size, thickness and strength relative to the marker 4 is critical to the easy removal, replacement and safe storage of the marker 4.

The knob 3 is located in the center front of the magnet 2. It is round and its parallel sides project a short distance beyond the outer plane of the marker 4 when it is stored. Shortly beyond that point the projecting end is rounded thereby making it easy to mate the hole in the marker 4 with the knob 3. This provision allows the marker 4 to be guided and attracted to its resting place on the magnet 2.

The marker 4 is of magnetizable material. It is round, about the size and thickness of a quarter and has a hole in its center that closely matches the diameter of the knob 3, but easily fits over it. The two faces of the marker 4 are suitably prepared to accept printing or marking for identity purposes.

Because the magnet 2 has thickness and is lesser in diameter than the marker 4 the overlapping edges of the marker 4 are easily grasped by the tips of thumb and second finger and by pressing on the knob 3 with the index finger the marker 4 can be pulled away from the attraction of the magnet and confinement of the knob 3.

The mating of the hole in the marker 4 with the knob 3 prevents lateral dislodgment.

The combination of magnetism and mating of marker 4 hole and knob 3 influence the safe storage of the marker 4 in the following way. The close fit of the marker 4 hole with the straight and parallel sides of the knob 3 demand that for removal the marker 4 be pulled a short distance while in a parallel plane to the magnet 2 to the point where the tip of the knob 3 becomes rounded. Any tipping of the marker 4 out of this plane before reaching the rounded part of the knob 3 would jam it and nullify any significant frontal movement of the interior edge of the marker 4. When this factor is combined with the attraction the magnet 2 has for the marker 4 in this position the chance of accidental frontal dislodgment is reduced to a remote and acceptable possibility.

Removal of the marker 4 from its secure position of the clip 1 is quickly and easily accomplished as is the return of the marker 4 to its mated position as described above. Both actions are done by feel rather than visual guidance. Very little practice is required to master these moves.

The above description shall not be construed as limiting the ways in which this invention may be practiced but shall be inclusive of many variations that do not depart from the broad interest of the invention.

Having described my invention what I claim as new is: A method of storing, removing and replacing a coin-sized marker to mark the position of a golf ball resting on a putting green.

1. A device for storing, removing and replacing a coin-sized marker to mark the position of a golf ball resting on a putting green, comprising;

a clip formed of metal or plastic shaped to have a spring-like quality which is worn over the waistband or belt of slacks or skirt;

a magnet affixed to the front of the clip and whose size, shape and strength relative to the marker is critical to the easy removal, replacement and safe storage of a marker;

a rounded knob which projects from the face of the magnet and when mated with a hole in a marker prevents lateral dislodgment of the marker, the shape and size of the knob in relation to the marker being instrumental along with the magnet in reducing the chance of frontal accidental dislodgment of the marker to a remote and acceptable possibility; and a marker having a center hole with a diameter which closely matches the diameter of the knob and mates with it and whose two faces are suitably prepared to accept printing for advertising or marking pen for identity purposes.

* * * * *